United States Patent [19]

Sylvester

[11] 4,050,634

[45] Sept. 27, 1977

[54] FIN TUBE DISTRIBUTION NOZZLE

[75] Inventor: John L. Sylvester, Santa Rosa, Calif.

[73] Assignee: Ecodyne Corporation, Lincolnshire, Ill.

[21] Appl. No.: 688,504

[22] Filed: May 20, 1976

[51] Int. Cl.[2] ..... A62C 31/02

[52] U.S. Cl. ..... 239/601; 239/602

[58] Field of Search ..... 165/DIG. 1, 174; 261/109; 239/193, 194, 589, 601, 602

[56] References Cited

U.S. PATENT DOCUMENTS

| | | | |
|---|---|---|---|
| 2,804,339 | 8/1957 | Barbour et al. | 239/601 |
| 3,072,346 | 1/1963 | Wahlin et al. | 239/601 X |
| 3,827,481 | 8/1974 | Mandy | 239/193 X |
| 3,899,553 | 8/1975 | Furlong et al. | 165/174 X |
| 3,912,164 | 10/1975 | Lefebvre et al. | 239/406 X |

*Primary Examiner*—John J. Love

*Attorney, Agent, or Firm*—Joel E. Siegel; Charles M. Kaplan

[57] ABSTRACT

A spray nozzle with a discharge surface defined by the formula $X = \pm 0.875D\text{-}t\text{-}0.5y\text{-}\sqrt{0.75Dy}$, with D being the outside diameter of a connected heat exchanger tube, and t being the thickness of such heat exchanger tube, does not create sufficient back pressure to destroy the thin film layer of liquid flowing down the inside of such heat exchanger tube.

7 Claims, 1 Drawing Figure

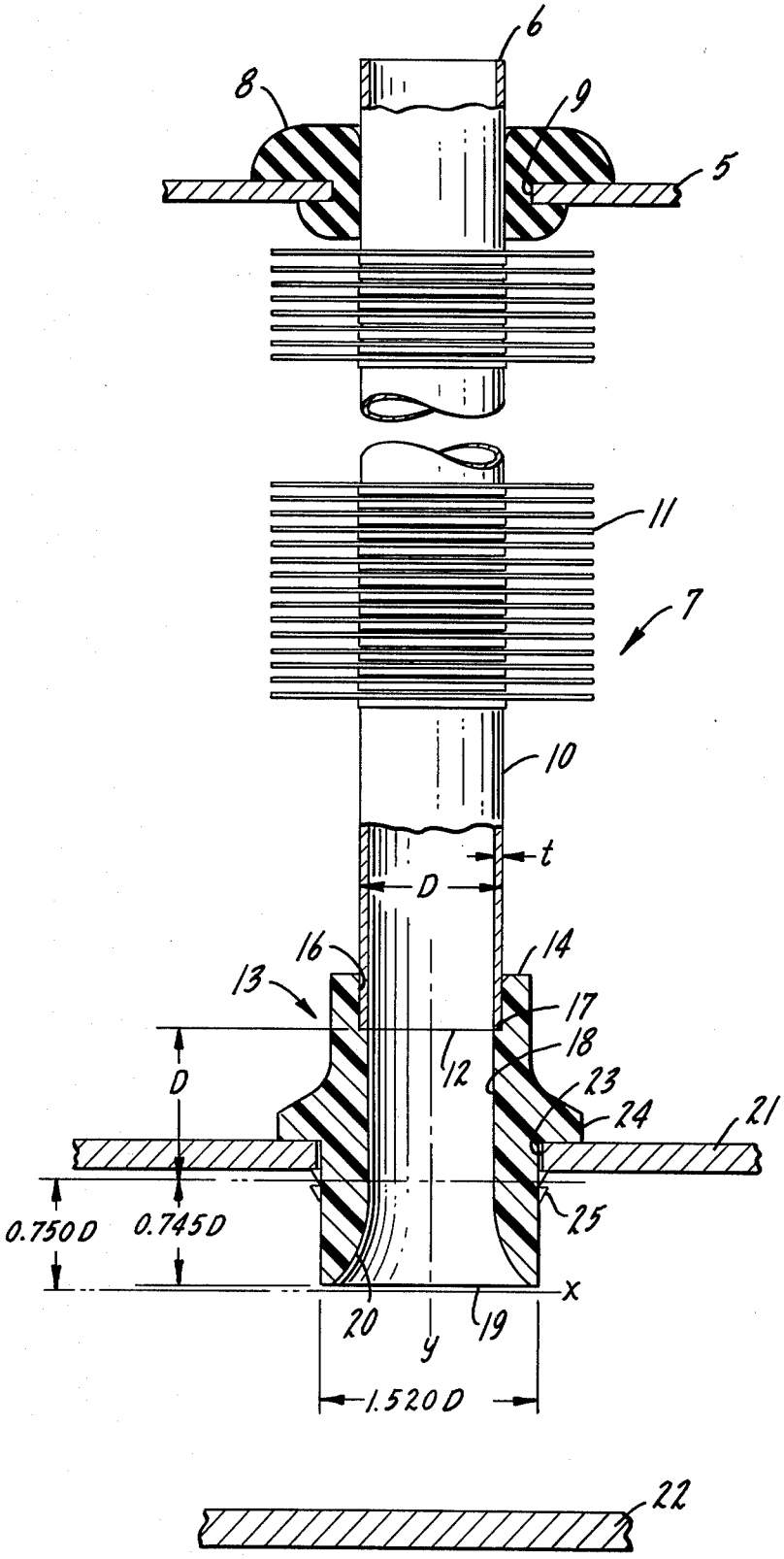
6
8
9
5
11
7
10
t
D
16
14
13
17
18
12
23
24
21
D
25
0.750D
0.745D
x
20
y
19
1.520D
22

FIN TUBE DISTRIBUTION NOZZLE

BACKGROUND OF THE INVENTION

This invention relates to nozzles, and more particularly to spray nozzles used to distribute hot liquid over the fill in a wet/dry cooling tower.

Under some climatic conditions, an objectionable amount of fog results from the moisture entrained in the air discharged from a liquid cooling tower. One way to prevent formation of fog is to heat a portion of the air discharged from the cooling tower by passing the liquid being cooled through finned tube heat exchangers before it is sprayed over the cooling tower fill or packing. The assignee of this application markets such a cooling tower under the registered trademark FOGLIMITOR®. Efficient heat transfer in finned tube heat exchangers requires that the liquid flow as a thin layer or film down the inside surface of the tubes. Prior art spray nozzles attached to the discharge end of finned tubes have created sufficient backpressure to disrupt or thicken the thin liquid film or layer, and thereby diminish the amount of heat transferred by such tubes. Also, solid objects in the liquid often clogged wuch prior art spray nozzles.

Accordingly, it is an object of this invention to provide an improved liquid spray nozzle.

Another object is to provide a liquid cooling tower having water to air finned tube heat exchangers with a nozzle that does not destroy the thin layer of liquid film flowing down the tubes.

Another object is to provide a relatively clog-free umbrella spray nozzle for use in liquid cooling towers.

Another object is to provide a spray nozzle that securely anchors the end of a heat exchanger tube in a wet/dry liquid cooling tower.

Another object is to provide a spray nozzle that improves the heat transfer efficiency of an attached heat exchanger.

Another object is to provide a spray nozzle that is relatively strong, lightweight, corrosion resistant, and inexpensive.

Still other objects and advantages of the invention will be revealed in the specification and claims, and the scope of the invention will be set forth in the claims.

DESCRIPTION OF THE DRAWING

The FIGURE shows a schematic, partially broken-away, cross section of a preferred embodiment of the invention.

DESCRIPTION OF A PREFERRED EMBODIMENT

The drawing shows a portion of a wet/dry liquid cooling tower of the type disclosed in application for U.S. Letters Pat. Ser. No. 484,485, filed July 1, 1974, which is assigned to the same assignee as this invention. Water to be cooled collects in a hot water distribution basin 5 and flows under the influence of gravity into the upper ends 6 of a plurality of finned tube heat exchangers 7 sealed by flexible rubber grommets 8 in water distribution holes 9. Each heat exchanger 7 comprises a circular tube 10 having a predetermined out diameter D and a predetermined wall thickness *t.* Sufficient fins 11 are provided to achieve the desired heat transfer. Tubes 10 and fins 11 may be made from suitable metals such as aluminum, copper, stainless steel, or a combination of such metals, or of plastics such as polyvinyl chloride, polypropylene, or polyethylene.

The bottom terminal end 12 of each tube 10 is received by a spray nozzle 13, which may be molded or machined from suitable plastics or metals. The upper end 14 of each nozzle 13 has a circular entrance groove 16 having the same depth as tube wall thickness t. Groove 16 thus defines a shoulder 17 in each tube having a depth equal to wall thickness *t.* Shoulders 17 define means for positioning terminal ends 12 at a predetermined location, and also insure that the circular inside surface 18 of each nozzle 13 is essentially a smooth continuation of the circular inside surface of its connected tube 10. Surface 18 continues unchanged from shoulder 17 for an axial distance equal to tube diameter D measured from terminal end 12. Thereafter surface 18 diverges outwardly for an axial distance equal to 0.745D to the terminal end 19 of nozzle 13. It has been determined empirically by experimentation and analysis that the objects of this invention are achieved when the cross sectional shape of the diverging portion 20 of surface 18 is defined by the formula $x = \pm 0.875D\text{-}t\text{-}0.5y\text{-}\sqrt{0.75Dy}$. The *y* axis is the logitudinal center line of tubes 10, the *x* axis is located a distance equal to 1.750D from tube terminal end 12, and the limits of the *x* axis are set by a distance equal to 1.520D centered on the *y* axis. To best achieve the objects of this invention, D would be in the range of 0.75 to 1.0 inches, and most preferably should be 1.0 inch, while *t* should be in the range of 0.035 to 0.090 inches, and most preferably should be 0.035 inches.

A deck 21 is supported in any conventional manner above suitable cooling tower fill 22. End 19 of each nozzle 13 passes through a circular hole 23 in deck 21 and a peripheral rim 24 on each nozzle 13 rests on deck 21. Cleats 25 on the exterior of each nozzle 13 lock the nozzles in holes 23. thus, nozzles 13 also prevent movement of the bottom ends 12 of heat exchangers 7 by securely anchoring ends 12 in deck 21. This insures that the liquid sprayed by the nozzles 13 will cover fill 22 in a predetermined circular pattern, thus making efficient use of heat exchangers 7 and fill 22 and optimizing heat transfer by the cooling tower.

In a cooling tower for lowering the termperature of hot water, heat exchangers 7 and nozzles 13 were assembled as disclosed herein. A flow control device of the type disclosed in said application for U.S. Letters Pat. Ser. No. 484,485, was connected to the upper end 6 of each tube 10 and regulated the flow of liquid thereinto. Tubes 10 were made of a cupro-nickel alloy and were 20 feet long; D was equal to 1.0 inch and *t* was equal to 0.035 inch. Each tube 10 had 11 fins per inch made of aluminum and 2.25 inches in diameter. Nozzles 13 were molded from polycarbonate plastic and fit into holes 23 which were 1.530 inches in diameter. Water at a temperature of 120° F entered each tube 10 and flowed therethrough at a rate of 3.4 gallons per minute. The layer of liquid film flowing down the inside of each tube 10 was 0.15 inches thick, and the temperature of the water sprayed from nozzles 13 was 102° F when the wet bulb temperature was 10.0° F. Three hundred seventy-nine cubic feet per minute of air was passed over fins 11. Nozzles 13 produced essentially no backpressure in tubes 10, so the thin film of liquid flowing down tubes 10 was not disrupted or thickened, and heat was transferred efficiently between water and air. Even though solid particles entered tubes 10, they did not form clogs because of the shape of surface 18 as defined by the formula disclosed herein does not obstruct flow.

It has thus been shown that by the practice of this invention, rugged, low cost nozzles 13 securely anchor and support the lower ends of heat exchangers above the fill in a wet/dry liquid cooling tower. The interior surface of the nozzles prevent creation of backpressure that would destroy the thin film which efficiently transfers heat from the liquid. Also, the diverging, unobstructed shape of the nozzle interior prevents clogging by solids in the liquid being cooled.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. An open ended nozzle for dispersing an umbrella-like spray from a thin film of liquid water flowing by gravity down a tube without creating sufficient back pressure to destroy such thin film, such tube having a predetermined wall thickness and an outside diameter sized to enable such tube to be received in an entrance opening at the upper end of said nozzle means for positioning said terminal end in said nozzle, the inner diameter of said nozzle being identical to the inner diameter of such tube for a distance equal to said tube outer diameter beginning at said terminal end, and the inner surface of the remainder of the cross sectional shape of said nozzle being defined by the following equation for an axial distance equal to 0.745 times said tube outer diameter:

$$x = \pm 0.875D - t - 0.5y - \sqrt{0.75Dy},$$

where

D = said outside diameter of such tube, t = said wall thickness of such tube, with the y axis being the longitudinal center line of said nozzle, and the $x$ axis being located a distance equal to 1.750D from said tube terminal end, and the limits of the $x$ axis being equal to the distance 1.520D centered on the $y$ axis.

2. A wet/dry water cooling tower in which water is sprayed over fill after passing by gravity flow as a thin film down the inside wall of a heat exchanger tube, an open ended spray nozzle attached to the bottom of such tube, said nozzle having an interior cross sectional shape defined by the following formula:

$$x = \pm 0.875D - t - 0.5y - \sqrt{0.75Dy},$$

where

D = outside diameter of such tube, $t$ = the wall thickness of such tube, and the $y$ axis is the longitudinal center line of said nozzle, and the x axis is located a distance equal to 1.750D from said bottom. whereby, insufficient backpressure is created by said nozzle to destroy the thin film of water being cooled on said inside wall of said tube.

3. The invention defined in claim 2, wherein D is in the range of from 0.75 to 1.0 inch, and $t$ is in the range of from 0.035 to 0.090 inch.

4. The invention defined in claim 3, wherein D is 1.0 inch and $t$ is 0.035 inch.

5. The invention defined in claim 2, wherein the the limits of the $x$ axis are equal to the distance 1.520D centered on the $y$ axis.

6. The invention defined in claim 2, wherein means in said nozzle positions said bottom at a predetermined location, said nozzle and said tube have identical inner diameters for a distance equal to D beginning at said bottom, and said cross sectional shape defined by said formula extends for an axial distance equal to 0.745D.

7. the invention defined in claim 6, wherein said means positioning said bottom at a predetermined location is a shoulder defined by a groove having a depth equal to $t$ at the entrance of said nozzle, so that the inside surface of said nozzle forms a continuation of the inside surface of said tube.

* * * * *

UNITED STATES PATENT AND TRADEMARK OFFICE

CERTIFICATE OF CORRECTION

PATENT NO. : 4,050,634

DATED : Sept. 27, 1977

INVENTOR(S) : John L. Sylvester

It is certified that error appears in the above-identified patent and that said Letters Patent are hereby corrected as shown below:

In column 1, line 24 delete "wuch" and insert -- such --.

In column 2, line 37 delete "thus" and insert --Thus--.

In column 3, line 23 delete "liquid".

In column 4, line 26 delete "the" second occurrence.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*